United States Patent [19]

Miller

[11] 4,278,204

[45] Jul. 14, 1981

[54] RAIL CLIP

[75] Inventor: David W. Miller, Retford, England

[73] Assignee: Pandrol Limited, London, England

[21] Appl. No.: 98,378

[22] Filed: Nov. 27, 1979

[30] Foreign Application Priority Data

Nov. 29, 1978 [GB] United Kingdom ..... 46519/78

[51] Int. Cl.[3] ..... E01B 9/48

[52] U.S. Cl. ..... 238/349

[58] Field of Search ..... 238/349

[56] References Cited

U.S. PATENT DOCUMENTS

| | | | |
|---|---|---|---|
| 3,297,253 | 1/1967 | Astley et al. | 238/349 |
| 4,047,663 | 9/1977 | Reynolds et al. | 238/349 |
| 4,150,791 | 4/1979 | Reynolds et al. | 238/349 |

FOREIGN PATENT DOCUMENTS

| | | | |
|---|---|---|---|
| 1519349 | 7/1978 | United Kingdom | 238/349 |

*Primary Examiner*—Richard A. Bertsch

*Attorney, Agent, or Firm*—Haseltine and Lake

[57] ABSTRACT

A rail clip, for holding down a railway rail, is made by bending a metal rod so that it comprises a substantially straight leg, at one end of which is one end of the rod, the other end of the leg being joined to a part on one side of the leg which is joined to a final part on the other side of the leg, this final part terminating in the other end of the rod, near which, on the under-side, a step in the rod is formed, this having a depth no more than 2 mm. or no more than ¼ of the thickness of the rod before it was bent. Apparatus for performing a second bending operation on a rod, which in a first bending operation has been given the shape indicated above but without the step, has support surfaces for supporting various parts of the bent rod and two shaping tools between which the final part of the rod is distorted to give it its final shape, including the step.

13 Claims, 13 Drawing Figures

Figure 1:
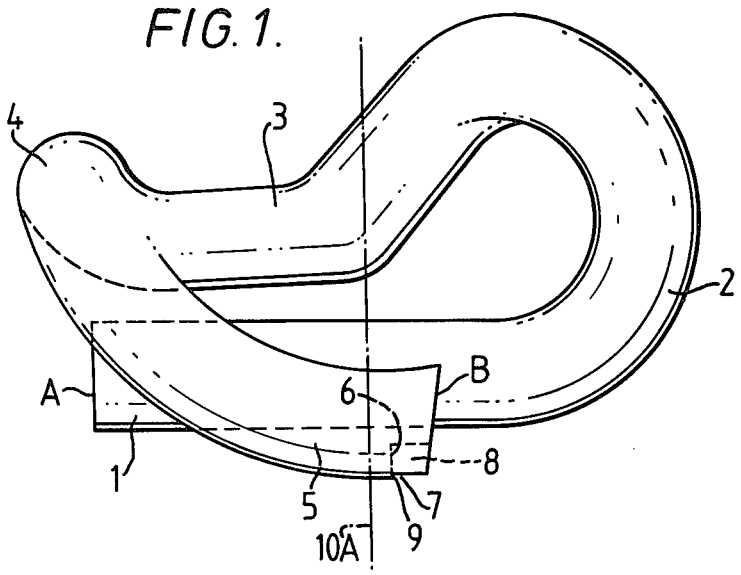

FIG. 3.
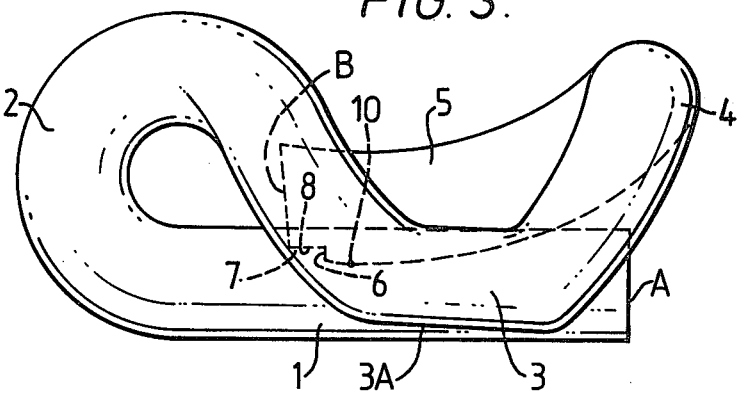
FIG. 4.
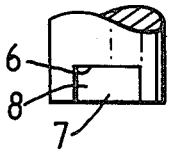
FIG. 5.
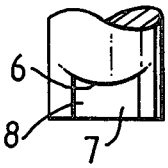
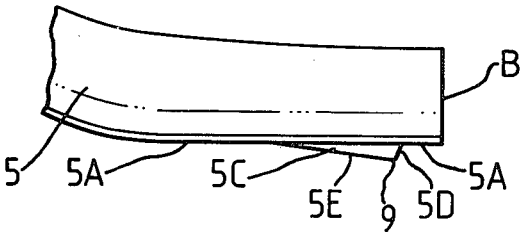
FIG. 6.
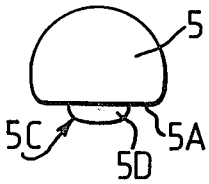
FIG. 7.
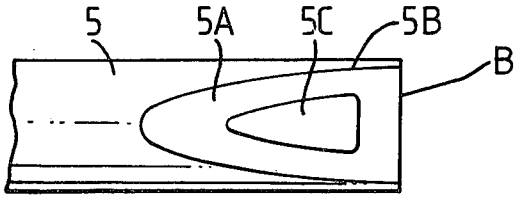
FIG. 8.

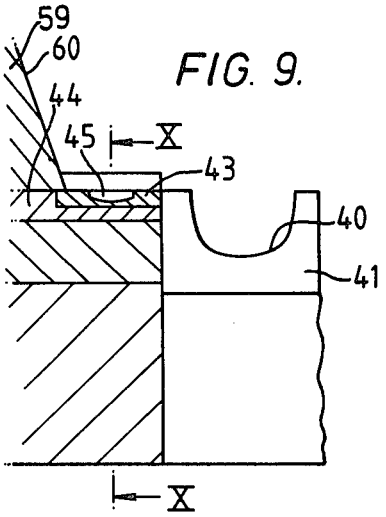
FIG. 9.
FIG. 10.
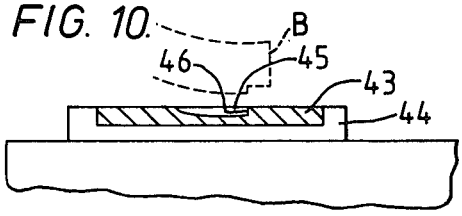
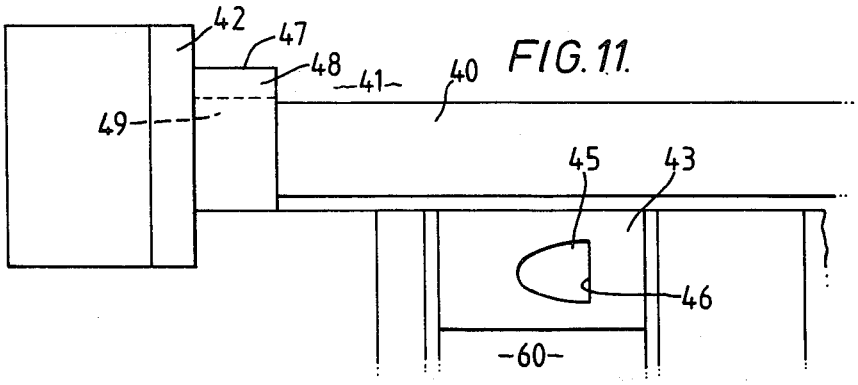
FIG. 11.

RAIL CLIP

This invention relates to a rail clip, for holding down a railway rail, comprising a rod of resilient metal, at least 8 mm. thick, which has been bent so that it comprises, proceeding from one end of the rod to the other end, a first portion which constitutes a substantially straight leg, a second portion in the form of a reverse bend, a third portion beside the first portion, a fourth portion in the form of a reverse bend and then a fifth portion which terminates at said other end of the rod and is beside the first portion, the configuration being such that when the clip is in a position (which is called below "the defined position") in which the first portion is horizontal and the lowest points at opposite ends of the first portion lie in the same horizontal plane as one another and the lowest points on the third and fifth portions lie in the same horizontal plane as one another, a section of the fourth portion lies vertically above and cross-wise over the axis of the first portion and when the clip is viewed from above the third and fifth portions appear to be on opposite sides of the first portion. A clip according to this definition is referred to below as a "P-R" clip; it was invented by Pande-Rolfsen—see his U.S. Pat. No. 3,004,716, which shows an elementary form of P-R clip, and U.S. Pat. No. 3,297,253 (Astley et al), which shows in FIGS. 1 to 3 a form of a P-R clip of which tens of millions have been made and sold.

The present invention is concerned with the problem of how to manufacture a large number of P-R clips with, for all of them, the same position, in the vertical sense, of the lowest point on the fifth portion with respect to the highest point on the first portion and with respect to the lowest point on the third portion (when the clip is free from stress but is in the defined position which is approximately its position of use) so that the so-called "deflection" of all the clips when they are driven into their positions of use will be approximately the same and so will the forces which they exert on the rail, assuming uniformity of the other relevant parts on the railway track, i.e. the rails, the anchorages for the clips, etc.

According to the present invention, there is provided a P-R clip comprising, on the underside of the fifth portion of the clip when the clip is in the defined position, a step which is at most 2 mm. high, or has a height of at most $\frac{1}{4}$ of the thickness of the rod before it was bent, the lowest point on the step, when the clip is in the defined position, being lower than any part of the clip which is beyond said step, proceeding from the third portion of the clip to said other end of the rod.

This shallow step can be formed without substantial weakening of the clip and it does not require for its production an extremely powerful pressing machine. By virtue of the step it is ensured that there is no part of the clip beyond the lowest point on the step, proceeding towards said other end of the rod, which is lower than the lowest point on the step, through inaccurate manufacture, and therefore produces, by bearing downwardly upon the surface upon which the lowest point on the step, or an even lower point on the other side of the step, is intended to bear downwardly, a greater deflection of the clip than would be obtained by the lowest point on the step or said even lower point bearing downwardly upon said surface.

Preferably, the height of the step (measured vertically, although the rising face of the step need not be vertical) is at most 1.5 mm., better still at most 1 mm. or at most 3/16 of the thickness of the rod, better still at most $\frac{1}{8}$ of the thickness of the rod, before the rod was bent.

Preferably, in order to keep to a minimum the length of the rod from which the clip is made, the part of the rod beyond the rising face of the step, proceeding from the third portion of the clip to said other end of the rod, has a length less than the thickness of the undeformed rod, better still less than half the thickness of the undeformed rod.

Figure 2:
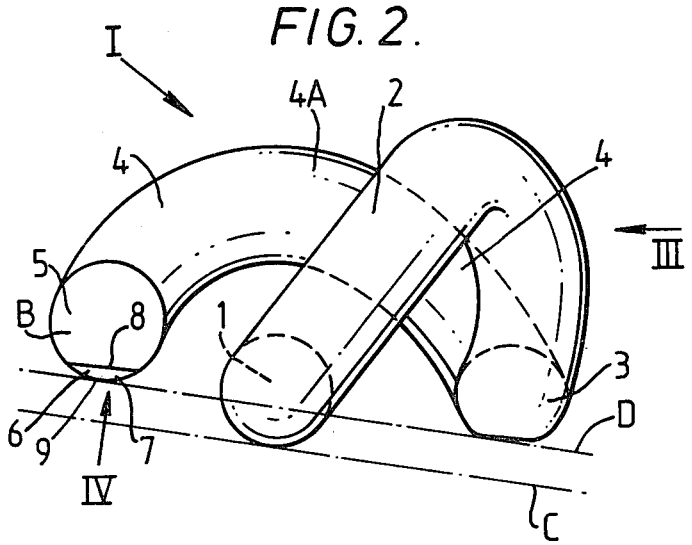
Figure 12:
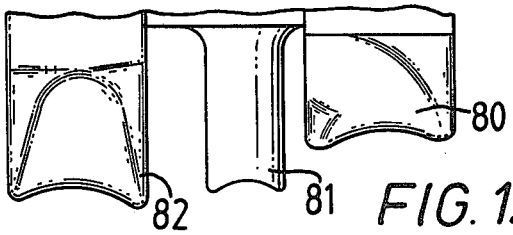
Figure 13:
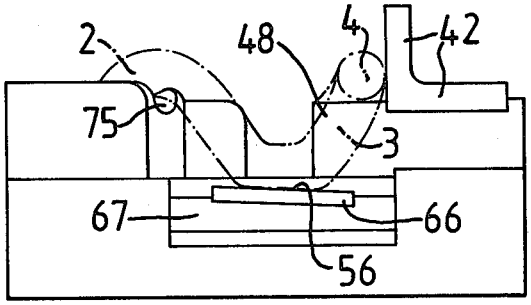

In the accompanying drawings:

FIG. 1 shows a side view of a rail clip according to the invention, taken as indicated by the arrow I in FIG. 2, FIG. 2 shows an end view of the same clip, FIG. 3 shows a side view of the same clip, taken as indicated by the arrow III in FIG. 2, FIG. 4 shows a view of part of the same clip, taken as indicated by the arrow IV in FIG. 2, FIG. 5 shows a view corresponding to FIG. 4 of part of a modified form of the clip according to FIGS. 1 to 4, this too being in accordance with the invention, FIG. 6 shows a side view of part of another modification of the clip according to FIGS. 1 to 4, this too being in accordance with the invention, FIGS. 7 and 8 show views of the clip according to FIG. 6, taken as indicated by the arrows VII and VIII, respectively, in FIG. 6, FIGS. 9 to 11 show three views of part of apparatus for producing the clip shown in FIGS. 1 to 4, FIGS. 9 and 10 showing side elevations and FIG. 11 a plan view and FIG. 10 showing a section taken as indicated by the arrows X in FIG. 9, and FIGS. 12 and 13 show side views of two more parts of the apparatus.

The clip shown in FIGS. 1 to 4 is made by bending a rod of resilient steel of circular cross-section and 20.6 mm. diameter so that it has, proceeding from the end A to the end B, a first portion 1 which starts at the end A and constitutes a straight leg, a second portion 2 in the form of a reverse bend, a third portion 3 beside the first portion 1, a fourth portion 4 in the form of another reverse bend and then a fifth portion 5 which is beside the first portion 1 and terminates at the end B of the rod. When the clip is in a particular position (referred to below as "the defined position") the first portion 1 is horizontal and the lowest points at opposite ends of the first portion lie in the same horizontal plane C (see FIG. 2) and the lowest points on the third and fifth portions lie in another and higher horizontal plane D, although the planes C and D could coincide or the plane D could be lower than the plane C. The planes C and D are not shown in FIG. 2 as horizontal and therefore the clip is shown in FIG. 2 not quite in the defined position. However, in the defined position a section 4A of the portion 4 lies vertically above and cross-wise over the axis of the first portion 1 and when the clip is viewed from above the third and fifth portions 3 and 5 appear to be on opposite sides of the first portion 1.

Near the end B of the rod, on the under side of the clip when the clip is in the defined position, there is a step comprising a vertical rising face 6 which is planar and forms a boundary of a recess 7 in the underside of the fifth portion of the clip, the recess extending to the end B of the rod and being bounded also by a planar face 8. The face 6 has a height of less than $1\frac{1}{2}$ mm. and in fact about 1 mm., measured vertically (when the clip is in the defined position) from the point 9 which is the lowest point on the step, i.e. the lowest point on the lower boundary of the face 6. The lowest point on the fifth portion 5 of the clip is referenced 10 in FIG. 3. For the sake of simplicity, it is not shown in FIG. 2. It cannot be seen in the view depicted in FIG. 1 but a plane containing it is shown in this Figure, referenced 10A. With the clip in the defined position, proceeding from the third portion 3 to the end B of the rod, there is beyond the face 6 no part of the clip which is as low as the point 9. The recess 7 has a length, measured along the rod, less than the thickness of the rod before its deformation and in fact less than half that thickness.

A flat surface 3A is formed on the lower side of the portion 3.

FIG. 5 shows a modification in which the face 6 is curved instead of planar. In both examples the face 6 could slope, considering FIG. 1, downwardly from right to left.

FIGS. 6 to 8 show a modification in which there is formed on the lower side of the fifth portion 5 of the clip a flat surface 5A, bounded by the line 5B, from which projects a nose 5C which is not as wide as the flat surface 5A, although it could be as wide as the latter or more nearly as wide as it than the drawings show. The nose is formed with a steeply sloping flank 5D and a less steeply sloping flank 5E, the two meeting at the lowest point 9 of the fifth portion, so that, proceeding along the lower side of the nose 5C towards the end B of the clip one encounters a step, starting at the point 9.

The clip shown in FIGS. 1 to 4 has been made by first forming two reverse bends, so that the bent rod has the shape shown in FIGS. 5 and 6 of U.S. Pat. No. 4,050,284, i.e. the general shape of a P-R clip as defined above, by the method described in the same specification with reference to FIG. 4 thereof. Then the clip has been given its desired final shape, as shown in FIGS. 1 to 4, by apparatus as described in U.S. Pat. No. 4,050,284 but modified as follows.

FIGS. 9 and 11 show a groove 40 in a member 41, along which the first portion 1 of a bent rod, formed with its two reverse bends as described above, slides until the leading part (on the fourth position 4) strikes a stop member 42. Three upper shaping tools 80, 81 and 82 (FIG. 12) are caused by means not shown to descend simultaneously to give the clip its desired final shape, one of them (81) holding the portion 1 down in the groove 40 and another (82) pushing the third portion 3 against a shaping surface 56 on an insert 66 (FIG. 13) which can be removed from a larger backing member 67 when worn and replaced by another and which gives the portion 3 its slightly inclined flat surface 3A. The third upper shaping tool (80) presses the fifth portion of the rod against shaping surfaces in an insert 43, which can be removed from a larger backing member 44 when worn and replaced by another. The insert has in its upper surface a recess 45 which is bounded at one end by a vertical wall 46. Part of the fifth portion of the bent rod is pressed into the recess 45 and is formed with the vertical face 6 (FIGS. 1 to 4) which faces and makes contact with the vertical wall 46 and another part of the fifth portion is pressed against the top of the insert 43 to the right (considering FIG. 10) of the recess 45 and is formed with the face 8 which faces and makes contact with the upper flat surface of the insert. FIG. 10 shows in dotted line the fifth portion of the finished clip vertically above the position which it occupies immediately after its shaping has been completed.

The descent of the upper shaping tools causes the fourth portion 4 of the bent rod to be bent around a convex surface 47 on a member 48 which is formed with a hole 49 which receives the end A of the bent rod. The second portion 2 of the bent rod is bent around a convex surface 75 (FIG. 13).

The backing member 44 is surmounted by a block 59 having an inclined surface 60 and the member 44 and block 59 can be moved together horizontally to left and right (considering FIG. 9) and fixed in their chosen positions so as to adjust and then fix the distance between the recess 45 in the insert 43 and the groove 40.

The modified clips according to FIG. 5 and FIGS. 6 to 8 can be made with the same apparatus but with appropriately differently shaped inserts 43, which produce steps having a vertical height of at most 2 mm. or at most $\frac{1}{4}$ of the thickness of the rod before it was bent, or lesser heights as indicated above.

I claim:

1. A rail clip, for holding down a railway rail, comprising a rod of resilient metal, at least 8 mm. thick, which has been bent so that it comprises, proceeding from one end of the rod to the other end, a first portion which constitutes a substantially straight leg, a second portion in the form of a reverse bend, a third portion beside the first portion, a fourth portion in the form of a reverse bend and then a fifth portion which terminates at said other end of the rod and is beside the first portion, the configuration being such that when the clip is in a position in which the first portion is horizontal and the lowest points at opposite ends of the first portion lie in the same horizontal plane as one another and the lowest points on the third and fifth portions lie in the same horizontal plane as one another, a section of the fourth portion lies vertically above and cross-wise over the axis of the first portion and when the clip is viewed from above the third and fifth portions appear to be on opposite sides of the first portion, the clip further comprising, near said other end of the rod, on the under-side of the clip when the clip is in said position, a step which is at most 2 mm. high, measured vertically, the lowest point on the step, when the clip is in said position, being lower than any other part of the clip which is beyond said step, proceeding from the third portion of the clip to said other end of the rod.

2. A clip according to claim 1 in which said step is at most 1.5 mm. high.

3. A clip according to claim 1 in which said step is at most 1 mm. high.

4. A clip according to claim 1 in which the part of the rod beyond the rising face of the step, proceeding from the third portion of the clip to said other end of the rod, has a length less than the thickness of the undeformed rod.

5. A clip according to claim 1 in which the part of the rod beyond the rising face of the step, proceeding from the third portion of the clip to said other end of the rod, has a length less than half the thickness of the undeformed rod.

6. A rail clip according to claim 1 in which the step is on one side of a nose projecting downwardly from the lower side of the fifth portion of the clip.

7. A rail clip according to claim 6 in which the nose has a steeply inclined flank on the side nearer said one end and a less steeply inclined flank on the opposite side.

8. A rail clip according to claim 6 in which the nose projects from a flat surface on the lower side of the fifth portion of the clip.

9. A rail clip, for holding down a railway rail, comprising a rod of resilient metal, at least 8 mm. thick, which has been bent so that it comprises, proceeding from one end of the rod to the other end, a first portion which constitutes a substantially straight leg, a second portion in the form of a reverse bend, a third portion beside the first portion, a fourth portion in the form of a reverse bend and then a fifth portion which terminates at said other end of the rod and is beside the first portion, the configuration being such that when the clip is in a position in which the first portion is horizontal and the lowest points at opposite ends of the first portion lie in the same horizontal plane as one another and the lowest points on the third and fifth portions lie in the same horizontal plane as one another, a section of the fourth portion lies vertically above and cross-wise over the axis of the first portion and when the clip is viewed from above the third and fifth portions appear to be on opposite sides of the first portion, the clip further comprising, near said other end of the rod, on the under-side of the clip when the clip is in said position, a step which has a height, measured vertically, of no more than $\frac{1}{4}$ of the thickness of the rod before it was bent, the lowest point on the step, when the clip is in said position, being lower than any other part of the clip which is beyond said step, proceeding from the third portion of the clip to said other end of the rod.

10. A clip according to claim 9 in which said step has a height at most 3/16 of the thickness of the rod before it was bent.

11. A clip according to claim 9 in which said step has a height at most $\frac{1}{8}$ of the thickness of the rod before it was bent.

12. A clip according to claim 9 in which the part of the rod beyond the rising face of the step, proceeding from the third portion of the clip to said other end of the rod, has a length less than the thickness of the undeformed rod.

13. A clip according to claim 9 in which the part of the rod beyond the rising face of the step, proceeding from the third portion of the clip to said other end of the rod, has a length less than half the thickness of the undeformed rod.

* * * * *